US008177058B2

(12) United States Patent
Cavallini

(10) Patent No.: US 8,177,058 B2
(45) Date of Patent: May 15, 2012

(54) TRAY AND SLIP SHEET FOR TRANSPORTING RUBBER

(76) Inventor: Carlos Cavallini, Guatemala (GT)

( * ) Notice: Subject to any disclaimer, the term of this patent is extended or adjusted under 35 U.S.C. 154(b) by 31 days.

(21) Appl. No.: 12/849,704

(22) Filed: Aug. 3, 2010

(65) Prior Publication Data

US 2012/0031808 A1 Feb. 9, 2012

(51) Int. Cl.
*B65D 71/00* (2006.01)

(52) U.S. Cl. ..... 206/83.5; 217/66; 206/597; 108/51.11

(58) Field of Classification Search ..... 206/596, 206/597, 83.5; 108/57.16; 217/66
See application file for complete search history.

(56) References Cited

U.S. PATENT DOCUMENTS 4,869,363 A * 9/1989 Goldberg ..... 206/83.5
5,246,128 A * 9/1993 Uitz ..... 220/4.28
5,613,447 A 3/1997 Trickett
5,881,651 A * 3/1999 Trickett ..... 108/51.11
6,490,982 B1 12/2002 Trickett
2006/0108249 A1 * 5/2006 Riddleburgh et al. ..... 206/453

OTHER PUBLICATIONS

U.S. Appl. No. 11/828972, Howard J. Trickett

* cited by examiner

*Primary Examiner* — J. Gregory Pickett
*Assistant Examiner* — Raven Collins
(74) *Attorney, Agent, or Firm* — Mark Terry

(57) ABSTRACT

A tray and slip sheet system for transporting aggregated bales of rubber that provides a manner for thawing rubber being transported, that prevents large rubber bales being transported from fusing together, and that does not damage or contaminate the packaged rubber when a forklift's forks are inserted between two stacked aggregated bales using the tray and slip sheet system. The tray and slip sheet system uses a tray sheet, a slip (when transporting more than one stacked aggregated bale of rubber), and a strap securing system. The tray and slip sheet system provides a system that defines an air recirculation system that allows the first two levels of bales of rubber stacked over the footprint to be defrosted in hot air chambers after winter transport. Systems not having ventilation slits do not allow the first two levels of bales being transported from being completely defrosted.

13 Claims, 4 Drawing Sheets

TRAY AND SLIP SHEET FOR TRANSPORTING RUBBER

BACKGROUND

The present invention relates generally to a tray and slip sheet system used to transport aggregated bales of rubber. The system uses recyclable materials and eliminates the need of the use of wooden pallets during the transport of rubber.

The tray and slip sheet system provides a means for arranging aggregations of small rubber bales into larger rubber bales that can be stacked and transported without the fear of the larger rubber bales being fused together. The larger rubber bales can weigh up to 1.26 metric tons, and as is known in the industry, if rubber is stacked up on each other, after a certain period of time, the rubber will fuse together, provided that enough force is applied at the juncture of the stacked rubber bales.

Various patents have disclosed devices in which rubber is presently being transported and of the need not to use wooden pallets to transport rubber. Patents describing the devices are as follows: U.S. Pat. Nos. 5,613,447, 5,881,651, and 6,490,982 all having been issued to Howard J. Trickett. Mr. Trickett has also applied for U.S. application Ser. No. 11/828,972, presently pending and having been published on Jan. 31, 2008. None of the patents or applications disclose a tray sheet and slip system that provides a means for thawing the rubber being transported, that prevents the rubber being stacked together from being fused, and that does not damage the packaged rubber when a forklift's forks are inserted between two stacked bales using the present tray and slip sheet system.

For the foregoing reasons, there is a need for a tray and slip sheet system for transporting rubber that will provide a means for thawing the rubber being transported, that prevents the large rubber bales being stacked together from being fused, and that does not damage the packaged rubber when a forklift's forks are inserted between two stacked rubber bales using the present tray and slip sheet system.

SUMMARY

The present invention is directed to a tray and slip sheet system for transporting aggregated bales of rubber that provides a means for thawing the rubber being transported, that prevents the larger rubber bales being stacked together from being fused, and that does not damage the packaged rubber when a forklift's forks are inserted between two stacked rubber bales using the present tray and slip sheet system.

The tray and slip sheet system comprises of a tray sheet, a slip, and securing system. The tray sheet has a foot print and four interconnecting flaps, each flap defines at least one rectangular ventilation slit and a securing mechanism. The tray sheet is used by placing the tray sheet on a flat surface and then placing a first layer of six bales within the footprint of the tray sheet. Up to six layers of bales can be stacked on the tray sheet. Each bale can weigh up to 35 kilograms and the tray sheet can support up to 2.52 metric tons. After the first two levels of bales are placed in the footprint, the flaps are raised and interconnected. Then the securing means, plastic straps, are threaded within apertures of each flap and then secured. When stacking the levels of rubber desired, usually a plastic film or wrap is placed between each level to prevent fusing and then the plastic film is wrapped around the exterior of the stacked bales to provide stability, thereby forming an aggregated bale. And when stacking aggregated bales, then placing a slip having a slip footprint and a slip flap on a bale aggregation so that the slip footprint is placed on the top of the bottom bale aggregation, then folding the slip flap over the side of the bottom aggregated bale, and then securing the slip flap with a slip securing strap.

An object of the present invention is to provide a tray and slip sheet system that will allow rubber being transported to thaw.

Another object of the present invention is to prevent the larger rubber bales being stacked together from being fused.

Yet, another object of the present invention is to maximize the space within a container when stacking aggregated bales within the container.

Still, another object of the present invention is to maximize the space in a warehouse when the system is not in use. For example, 180 tray sheets occupy the same space as one wooden pallet.

A further object of the present invention is to eliminate the need of the use of wooden or plastic pallets when transporting bales of rubber.

Yet, a further object of the present invention is to reduce the total weight of containers using the present invention.

Still, a further object of the present invention is to provide a rubber bale carrying system that is recyclable.

Yet still a further object of the tray and slip sheet system is to provide a system that defines an air recirculation system that allows the first two levels of bales stacked over the footprint to be defrosted in hot air chambers after winter transport. Systems not having ventilation slits do not allow the first two levels of bales being transported from being completely defrosted. This causes problems when using the rubber to produce end products, e.g., if producing tires, the tires produced will not have the same consistency.

DRAWINGS

These and other features, aspects, and advantages of the present invention will become better understood with regard to the following description, appended claims, and drawings where:

DESCRIPTION

Figure 1:
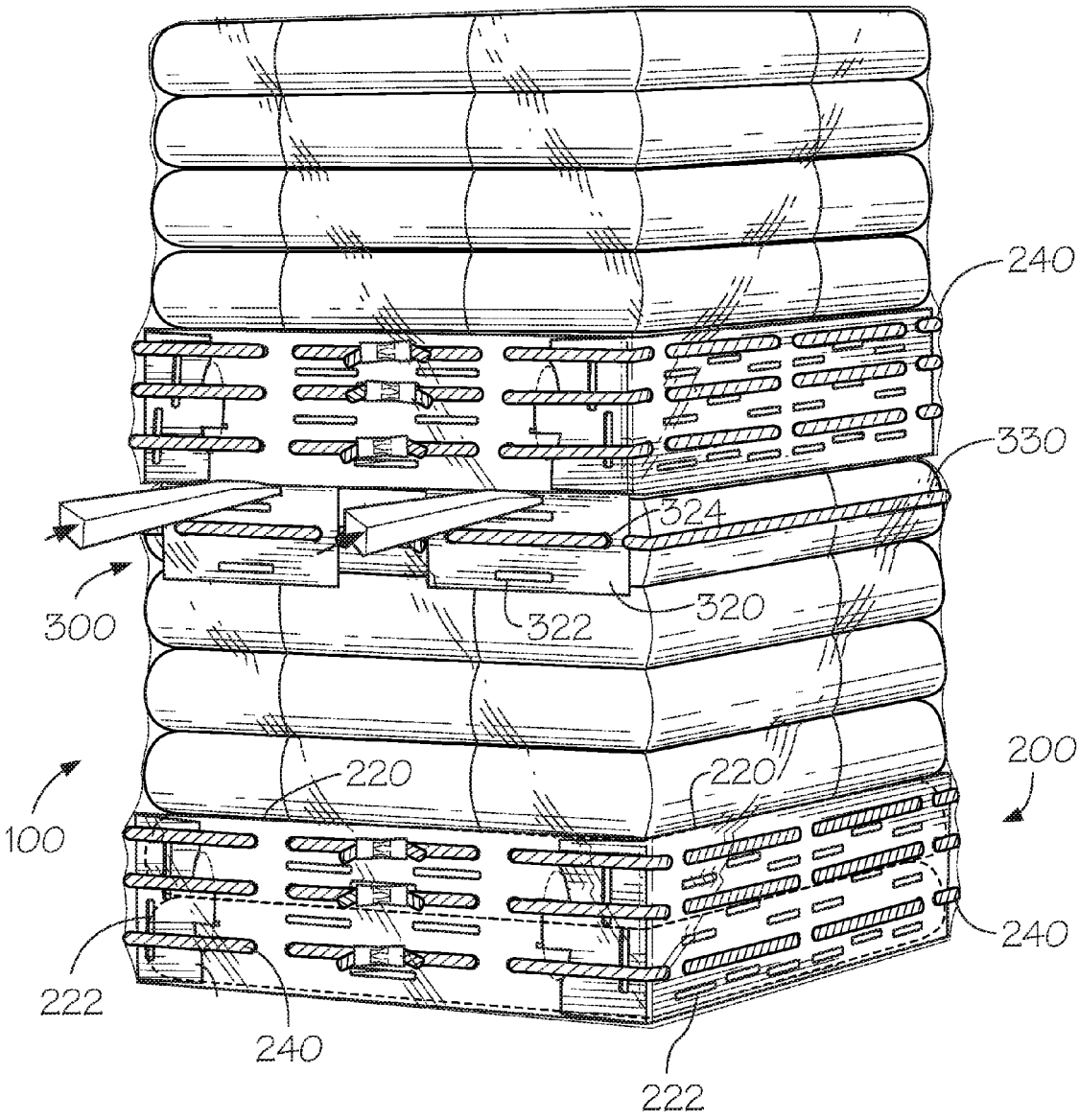
FIG. 1 shows a perspective view of a tray and slip sheet system having six levels of bales stacked within each tray and slip sheet system, the figure shows how the forks from a fork lift would slide between each system when lifting an upper tray and slip sheet system.
Figure 2:
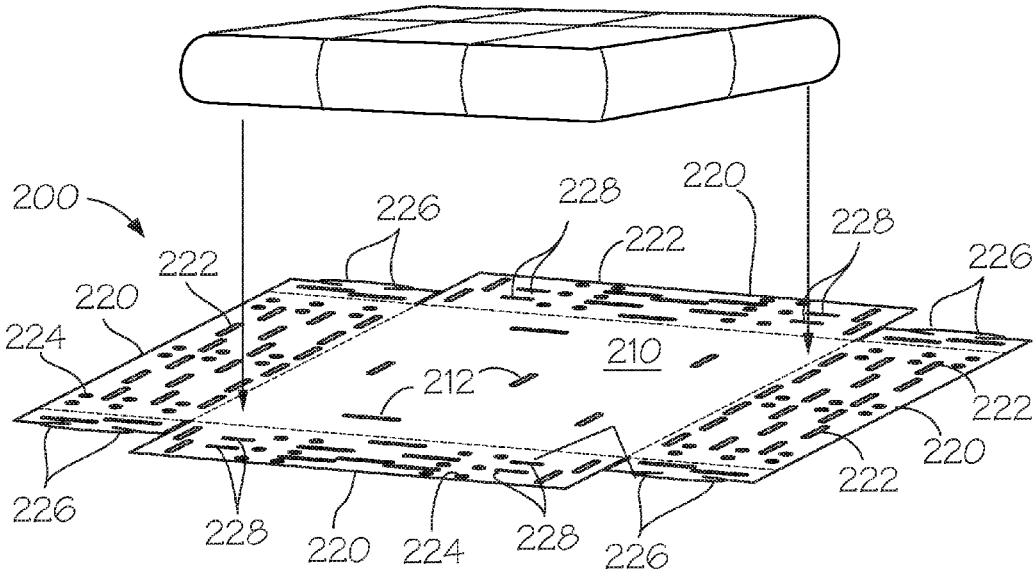
FIG. 2 shows a perspective view of how a composite (each bale is not shown) of six bales would be placed on the footprint of the tray sheet.
Figure 3:
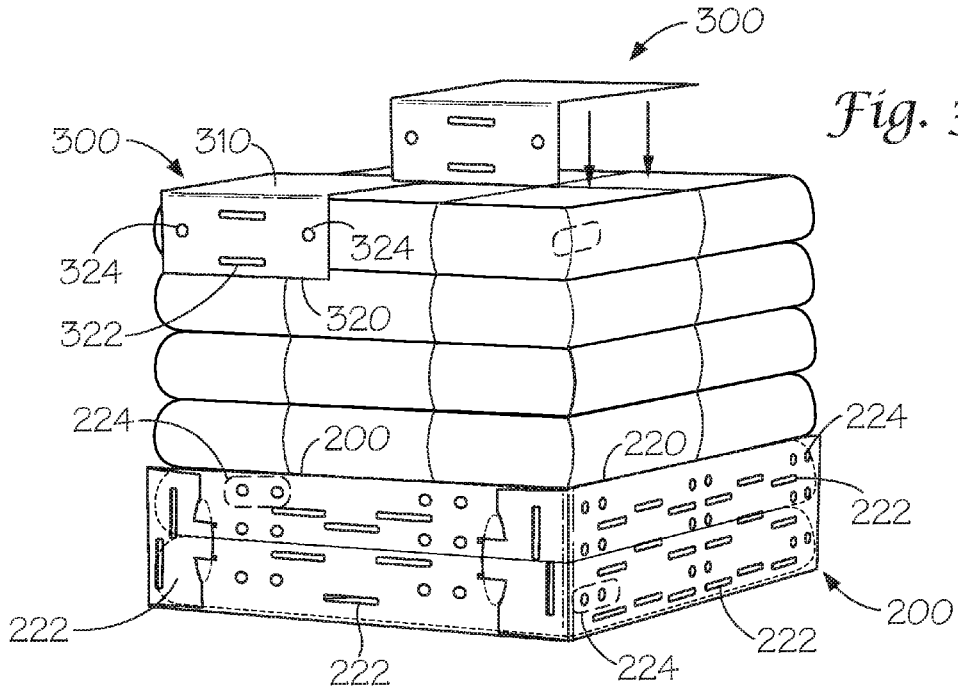
FIG. 3 shows a perspective view of the tray and slip sheet system, wherein the flaps of tray sheet are interconnected, six levels of bales are on the footprint of the tray sheet, and how at least one slip would be placed on the top level of bales placed on the tray sheet.
Figure 4:
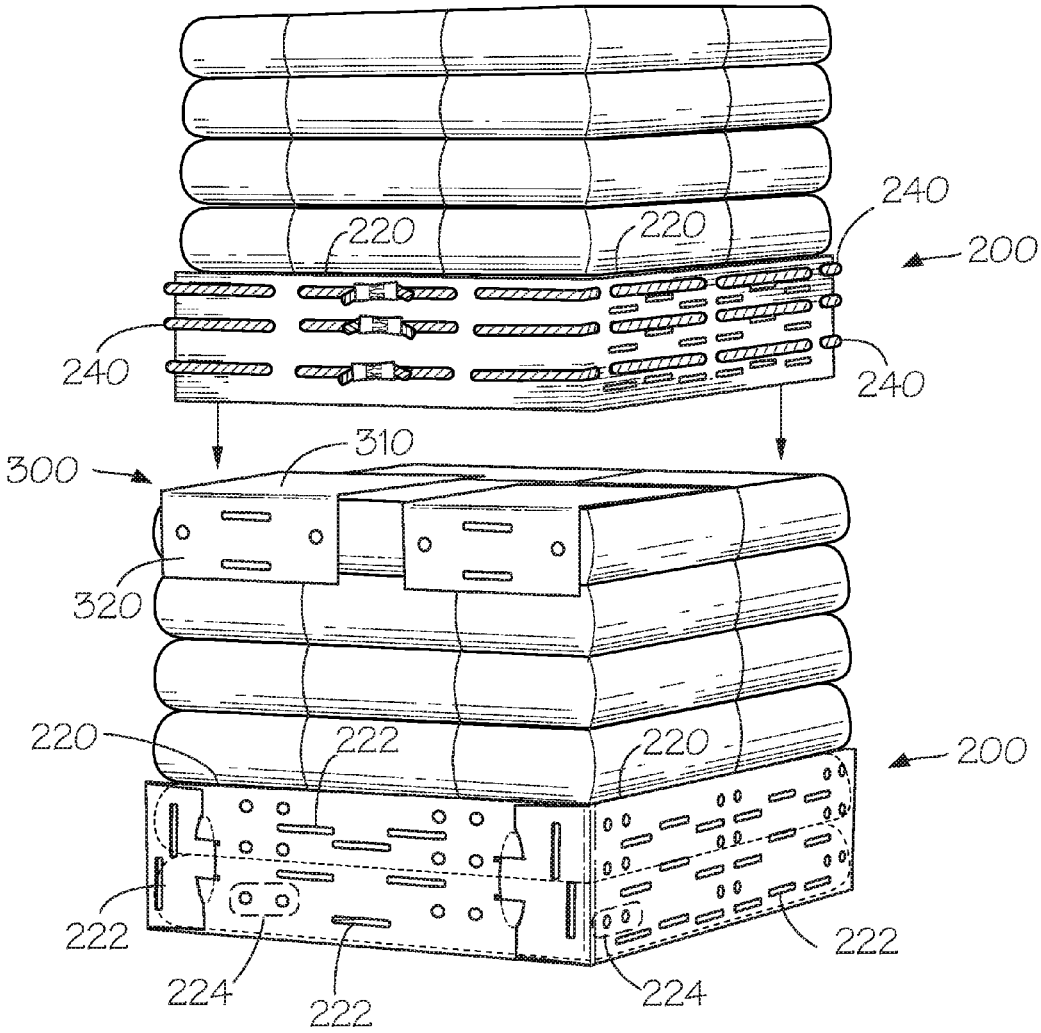
FIG. 4 shows a perspective view of how one tray and slip sheet system would be stacked upon another.
Figure 5:
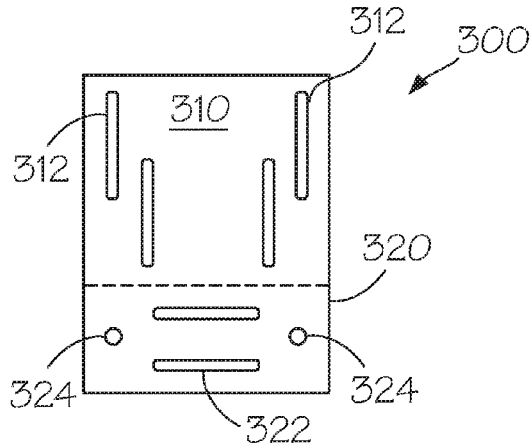
FIG. 5 shows a top plan view of the slip that would be placed on top of the top level of bales placed on each tray sheet.
Figure 6:
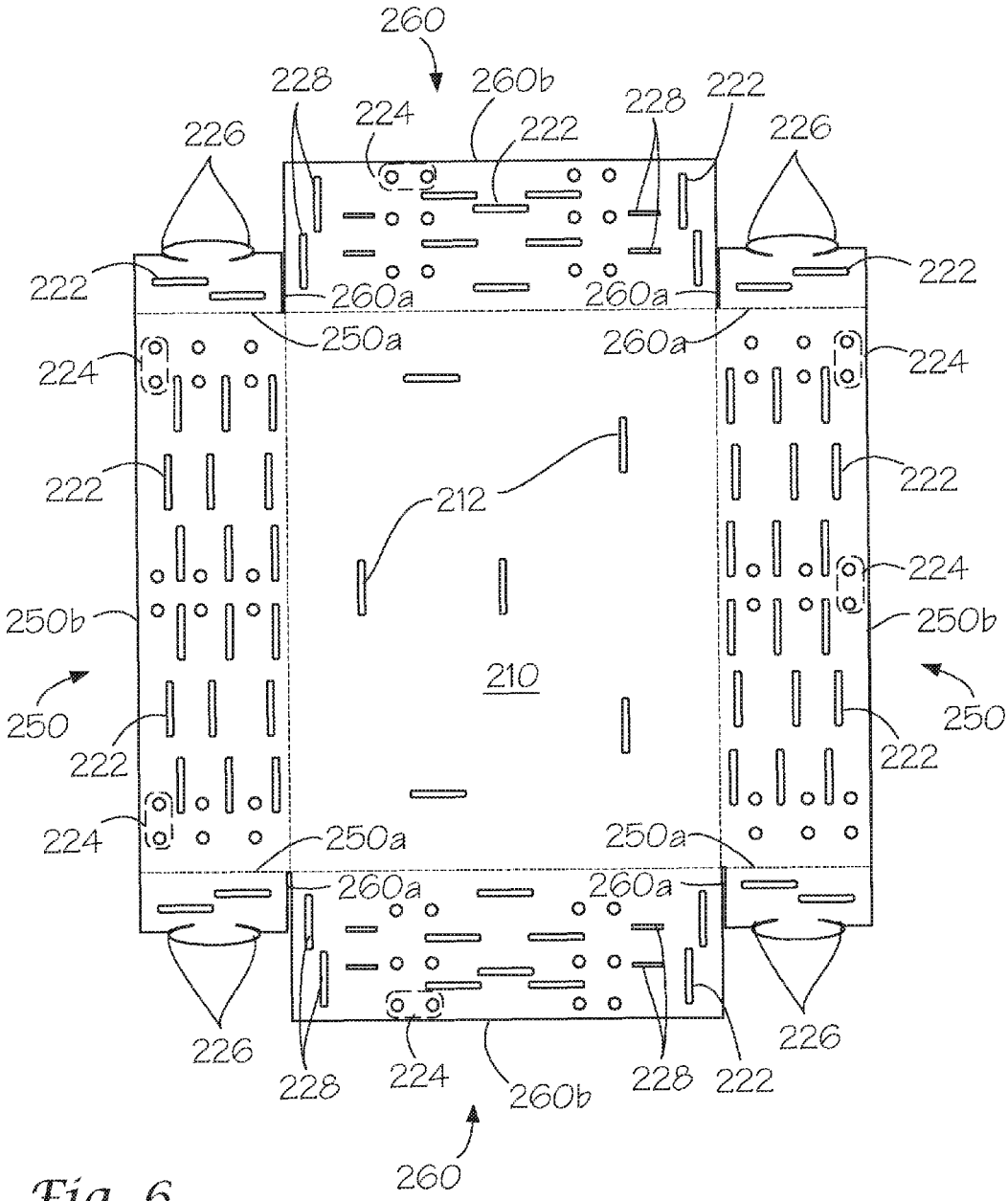
FIG. 6 shows a top plan view of the tray sheet.

As seen in FIGS. 1-3, a tray and slip sheet system 100 for transporting aggregated bales of rubber, comprises, as seen in FIGS. 2 and 6, a tray sheet 200, the tray sheet 200 having a footprint, two opposing long tray sheet flaps, and two opposing short tray sheet flaps, the tray sheet foot print 210 defines at least one rectangular ventilation slit 212, each of the tray sheet flaps 220 define at least one rectangular ventilation slit 222 and at least a pair of strap apertures 224 in which a securing means 240 could be threaded through, each of the long tray sheet flaps defines a set of female receiving means at each opposite end of each long tray sheet flap and each of the short tray sheet flaps defines a set of male appendages at each opposite end of each short tray sheet so that when the tray sheet flaps are folded in a perpendicular position from the footprint, each set of appendages slides into each set of vertical female receiving apertures. In a preferred embodiment of the present invention, each tray sheet flap 220 might have at least three levels of strap apertures 224 and each level would have at least two pairs of strap apertures 224, the strap apertures 224 would be positioned at a same position within each level. As seen in FIG. 1, the tray and slip sheet system 100 of the present invention, further comprises of at least one tray sheet strap 240, the tray sheet strap 240 might be made of rubber, and is threaded within each strap aperture 224 of each tray sheet flap 220 and then secured together. As seen in FIGS. 3 and 5, the present invention further might comprise of at least one slip 300, each slip 300 having a slip footprint 310 and a slip flap 320, the slip foot print 310 defines at least one rectangular ventilation slit 312, each slip flap 320 further defines at least one rectangular ventilation slit 322 and at least one pair of slip strap apertures 324, and a slip strap 330, the slip strap 330 is threaded through the pair of slip strap apertures 324 and is connected after the slip 300 is placed over an aggregation of bales of rubber after the aggregation of bales of rubber have been placed and secured over the footprint 210 of the sheet tray 200.

In a preferred embodiment of the preferred invention, the tray and slip sheet system 100 has a length of 80.75 inches and a width of 68.50 inches and a height of 1.00 millimeter. The footprint 210 of the tray sheet 200 has a length that is 52.75 inches and a width of 40.50 inches. The slip 300 has a length of 20 inches, a width of 15 inches, and a height of 1.00 millimeter. The footprint 310 of the slip 300 has a length of 13.00 inches and a width of 15.00 inches, while the slip flap 320 has a length of 7.00 inches and a width of 15.00 inches.

All of the rectangular ventilation slits 212/222/312/322 of the present invention define apertures measuring at least 0.50 of an inch width and at least 5.00 inches in length. The ventilation slits 212/222/312/322 are needed to allow the rubber being transported to breath during the thaw process. The ventilation slits 212/222/312/322 are positioned throughout the sheet tray 200 and slip 300 to maximize the amount of ventilation that could contact the aggregated rubber bale without compromising the tray sheets 200 carrying capacity.

In a preferred embodiment, the tray sheet's 200 rectangular ventilation slits 210/222 measure 0.50 of an inch in width and are 5.00 inches in length. The tray sheet footprint 210 defines six rectangular ventilation slits 212. The tray sheet flaps 220 define sixty-four rectangular ventilation slits 222, the slits 222 are positioned so that each long tray sheet flap 250 defines twenty-two rectangular ventilation slits 222 and each short tray sheet flap 260 defines ten rectangular ventilation slits 222. The slip's rectangular ventilation slits 322 measure 0.75 of an inch in width and measure 5.00 inches in length, wherein the slip footprint 310 defines four rectangular ventilation slits 312 and the slip flap 320 defines two rectangular ventilation slits 322.

In another embodiment of the present invention, the long tray sheet flaps 250 have a width of 14 inches, the short sides 250*a* of the long tray sheet flaps 250, and have a length of 52.75 inches, the long side 250*b* of the long tray sheet flap 250. There are two opposing long tray sheet flaps 250. Each long tray sheet flap 250 has 3 sets of 6 slip strap apertures 224. The sets 224 are distributed within each long tray sheet flap 250 so that a first set of slip strap apertures 224 is adjacent to one of the short sides 250*a* of the long tray sheet flaps 250, a second set 224 is parallel to the first set of slip strap apertures 224 and is centrally located on the long tray sheet flap 250, and a third set of slip strap apertures 224 is adjacent to the other short side 250*a* of the long tray sheet flap 250. Each long tray sheet flap 250 has 3 sets of 6 rectangular ventilation slits 222. The sets are distributed within each long tray sheet flap 250 so that the first set of rectangular ventilation slits 222 are adjacent to the long side 250*b* of the long tray sheet flat, the second set of the rectangular ventilation slits 222 are parallel to first set of the rectangular ventilation slits 222 and are centrally located within the long tray sheet flap 250, and the third set of rectangular ventilation slits 222 are parallel to the second set of rectangular ventilation slits 222 and are adjacent to the footprint 210. Each long tray sheet flap 250 defines an additional two sets of two rectangular apertures 222 that run adjacent to the short sides 250*a* of the long tray sheet flaps 250.

The short tray sheet flaps 260 have a width of 14 inches, the short sides 260*a* of the short tray sheet flaps 260, and a length of 40.5 inches, the long sides 260*b* of the short tray sheet flaps 260. There are two opposing short tray sheet flaps 260. Each short tray sheet flap 260 has 2 sets of 6 slip strap apertures 224. The sets 224 are distributed within each short tray sheet flap 260 so that a first set of slip strap apertures 224 is approximately 9.5 inches from one of the short sides 260*a* of the short tray sheet flap 260 and the second set of slip strap aperture 224 is approximately 9.5 from the other side of the short side 260*a* of the short tray sheet flap 260. Each short tray sheet flap 260 has six staggered rectangular ventilation slits 222 centrally located within the short tray sheet flap 260 and two sets of two rectangular ventilation slits 222, each set of two rectangular ventilation slits 222 runs adjacent to each short side 260*b* of the short tray sheet flap 260.

Note, each rubber bale is placed on the tray sheet footprint 200 weighs thirty-five kilograms and is positioned so that three bales of rubber shall be positioned side by side in the tray sheet along the length of the footprint and a second set of three bales of rubber shall be placed immediately behind the initial three bales of rubber so that a 3 by 2 pattern emerges within each level of rubber stacked within the footprint. Each tray sheet footprint 200 can support six levels of rubber bales once the flaps of the tray sheet are secured in place. The flaps will cover the first two levels of bales stacked.

As seen in FIG. 1, in practice, after at least the first two levels of bales are placed in the tray sheet footprint 200, the flaps 220 are raised and interconnected. Then the securing means 240, plastic straps, are threaded within apertures 224 of each flap 220 and then secured. After stacking the levels of rubber desired, usually a plastic film or wrap is wrapped around the bales to prevent impurities from contaminating the rubber and thereby forming an aggregation of bales of rubber.

When stacking aggregated bales of rubber using the present invention, the slip's 300 footprint 310 is placed on the top of the bottom bale aggregation being stacked, the slip flap 320 is folded over the side of the aggregated bale and then is secured by the slip strap 330.

The tray sheet and slip of the present invention might be made of HDPE, high density polyethylene. Yet, the system may be made of any other recycled rubber having an ethylene composition.

An advantage of the present invention is that it provides a tray and slip sheet system that allows rubber transported to thaw.

Another advantage of the present invention is that it prevents stacked aggregations of rubber bales from fusing together.

Yet, another advantage of the present invention is that it maximizes the space within a container when stacking aggregated bales within the container.

Still, another advantage of the present invention is that it maximizes the space in a warehouse when the system is not in use.

A further advantage of the present invention is that it eliminates the need of the use of wooden or rubber pallets when bales of rubber are transported.

Yet, a further advantage of the present invention is that it reduces the total weight of containers using the present invention.

Still, a further advantage of the present invention is that it provides a rubber bale carrying system that is recyclable.

Yet further advantage of the tray and slip sheet system is that it provides a system that defines an air recirculation system that allows the first two levels of bales stacked over the footprint to be defrosted in hot air chambers after winter transport. Systems not having ventilation slits do not allow the first two levels of bales being transported from being completely defrosted.

Although the present invention has been described in considerable detail with reference to certain preferred versions thereof, other versions are possible. Therefore the spirit and the scope of the claims should not be limited to the description of the preferred versions contained herein.

What is claimed is:

1. A tray and slip sheet system for transporting aggregated bales of rubber, comprises:

A tray sheet for placement on an underside of a stack of one or more bales of rubber, the tray sheet having a footprint, two opposite long tray sheet flaps, and two opposite short tray sheet flaps, the tray sheet foot print defining at least one ventilation slit, each of the tray sheet flaps defining at least one ventilation slit and at least a pair of strap apertures through which a strap is threaded, each of the long tray sheet flaps defining a set of female receiving apertures at each opposite end of each long tray sheet flap and each of the short tray sheet flaps defining a set of male appendages at each opposite end of each short tray sheet flap so that when the tray sheet flaps are folded in a perpendicular position from the footprint, each set of male appendages slides into each set of female receiving apertures;

at least one tray sheet strap threaded through each strap aperture of each tray sheet flap, wherein two ends of the at least one tray sheet strap are secured together with a fastener after the tray sheet flaps are folded in a perpendicular position from the footprint and the stack of one or more bales of rubber are placed in the tray sheet, wherein the at least one tray sheet strap comprises a semi-rigid, flat strip;

at least one slip for placement on top of the stack of one or more bales of rubber, each slip having a slip footprint and a slip flap, the slip foot print defining at least one ventilation slit, and the slip flap defining at least one slip ventilation slit and at least one pair of slip strap apertures; and at least one slip strap threaded through each slip strap aperture, wherein two ends of the at least one slip trap are secured together with a fastener after the at least one slip is placed on top of the stack of one or more bales of rubber and the slip flap is folded in a perpendicular position from the slip footprint, wherein the at least one slip strap comprises a semi-rigid, flat strip.

2. The tray and slip sheet system for transporting aggregated bales of rubber of claim 1, wherein each tray sheet flap includes at least three levels of strap apertures and each level includes at least two pairs of strap apertures, the strap apertures being positioned at a same position within each level.

3. The tray and slip sheet system for transporting aggregated bales of rubber of claim 2, wherein the tray sheet has a length of 80.75 inches and a width of 68.50 inches and a height of 1.00 millimeter and the footprint of the tray sheet has a length that is 52.75 inches and a width of 40.50 inches.

4. The tray and slip sheet system for transporting aggregated bales of rubber of claim 3, wherein the tray sheet ventilation slits measure 0.50 of an inch in width and are 5.00 inches in length, the tray sheet footprint defines six ventilation slits and the tray sheet flaps define sixty-four ventilation slits, wherein the slits are positioned so that each long tray sheet flap defines twenty-two ventilation slits and each short tray sheet flap defines ten ventilation slits.

5. The tray and slip sheet system for transporting aggregated bales of rubber of claim 4, wherein the at least one slip comprises four slips, wherein each slip is positioned at a corner of the stack.

6. The tray and slip sheet system for transporting aggregated bales of rubber of claim 5, wherein the at least one slip has a length of 20.00 inches, a width of 15.00 inches, and a height of 1.00 millimeter, and the footprint of the slip has a length of 13.00 inches and a width of 15.00 inches, and the slip flap has a length of 7.00 inches and a width of 15.00 inches.

7. The tray and slip sheet system for transporting aggregated bales of rubber of claim 6, wherein the slip's ventilation slits measure 0.75 of an inch in width and measure 5.00 inches in length, and wherein the slip footprint defines four ventilation slits and the slip flap defines two ventilation slits.

8. The tray and slip sheet system for transporting aggregated bales of rubber of claim 4, wherein the long tray sheet flaps have a width of 14 inches, the short sides of the long tray sheet flaps, and have a length of 52.75 inches, the long side of the long tray sheet flap, there are two opposing long tray sheet flaps, each long tray sheet flap has 3 sets of 6 slip strap apertures, the sets are distributed within each long tray sheet flap so that a first set of slip strap apertures is adjacent to one of the short sides of the long tray sheet flaps, a second set is parallel to the first set of slip strap apertures and is centrally located on the long tray sheet flap, and a third set of slip strap apertures is adjacent to the other short side of the long tray sheet flap, each long tray sheet flap has 3 sets of 6 ventilation slits, the sets are distributed within each long tray sheet flap so that the first set of ventilation slits are adjacent to the long side of the long tray sheet flat, the second set of the ventilation slits are parallel to first set of the ventilation slits and are centrally located within the long tray sheet flap, and the third set of ventilation slits are parallel to the second set of ventilation slits and are adjacent to the footprint, and each long tray sheet flap defines an additional two sets of two apertures that run adjacent to the short sides of the long tray sheet flaps.

9. The tray and slip sheet system for transporting aggregated bales of rubber of claim 8, wherein the short tray sheet flaps have a width of 14 inches, the short sides of the short tray sheet flaps, and a length of 40.5 inches, the long sides of the short tray sheet flaps, there are two opposing short tray flaps, each short tray sheet flap has 2 sets of 6 slip strap apertures, the sets are distributed within each short tray sheet flap so that a first set of slip strap apertures is approximately 9.5 inches from one of the short sides of the short tray sheet flap and the second set of slip strap aperture is approximately 9.5 from the other side of the short side of the short tray sheet flap, each short tray sheet flap has six staggered ventilation slits centrally located within the short tray sheet flap and two sets of two ventilation slits, and each set of two ventilation slits runs adjacent to each short side of the short tray sheet flap.

10. The tray and slip sheet system for transporting aggregated bales of rubber of claim 9, wherein the at least one slip comprises four slips, wherein each slip is positioned at a corner of the stack.

11. The tray and slip sheet system for transporting aggregated bales of rubber of claim 10, wherein the at least one slip has a length of 20.00 inches, a width of 15.00 inches, and a height of 1.00 millimeter, and the footprint oldie slip has a length of 13.00 inches and a width of 15.00 inches, and the slip flap has a length of 7.00 inches and a width of 15.00 inches.

12. The tray and slip sheet system for transporting aggregated bales of rubber of claim 11, wherein the slip's ventilation slits measure 0.75 of an inch in width and measure 5.00 inches in length, and wherein the slip footprint defines four ventilation slits and the slip flap defines two ventilation slits.

13. The tray and slip sheet system for transporting aggregated bales of rubber of claim 12, wherein the tray sheet and the at least one slip are made of high density polyethylene.

* * * * *